US007432659B2

(12) United States Patent
Park et al.

(10) Patent No.: US 7,432,659 B2
(45) Date of Patent: Oct. 7, 2008

(54) BACK LIGHT UNIT AND LIQUID CRYSTAL DISPLAY DEVICE USING THE SAME

(75) Inventors: Hee Jeong Park, Bucheon-shi (KR); Haang Rhym Chu, Suwon-si (KR)

(73) Assignee: LG Display Co., Ltd., Seoul (KR)

( * ) Notice: Subject to any disclaimer, the term of this patent is extended or adjusted under 35 U.S.C. 154(b) by 385 days.

(21) Appl. No.: 11/299,655

(22) Filed: Dec. 13, 2005

(65) Prior Publication Data

US 2006/0187180 A1 Aug. 24, 2006

(30) Foreign Application Priority Data

Feb. 23, 2005 (KR) ..... 10-2005-0014901

(51) Int. Cl.
*H05B 37/02* (2006.01)

(52) U.S. Cl. ..... 315/156; 315/157; 315/158

(58) Field of Classification Search ..... 315/149, 315/156–159, 169.3; 362/276
See application file for complete search history.

(56) References Cited

U.S. PATENT DOCUMENTS

2004/0246722 A1* 12/2004 Chang et al. ..... 362/276

* cited by examiner

*Primary Examiner*—David Hung Vu
(74) *Attorney, Agent, or Firm*—McKenna Long & Aldridge LLP

(57) ABSTRACT

A back light unit and an LCD device using the same in which current which flows in a plurality of light emitting diodes (LEDs) is uniformly controlled having a small PCB is provided. The back light unit includes a plurality of LED arrays having LEDs and a detector which detects a feedback signal which corresponds to a current that is input to the LEDs. The backlight unit also includes a driver which drives the LEDs in accordance with the feedback signal from the detector.

11 Claims, 5 Drawing Sheets

BACK LIGHT UNIT AND LIQUID CRYSTAL DISPLAY DEVICE USING THE SAME

This application claims the benefit of the Korean Patent Application No. P2005-14901, filed on Feb. 23, 2005, which is hereby incorporated by reference for all purposes as if fully set forth herein.

BACKGROUND OF THE INVENTION

1. Field of the Invention

The present invention relates to a liquid crystal display (LCD) device, and more particularly, to a back light unit and an LCD device using the same in which current flow in a plurality of light emitting diodes (LEDs) is uniformly controlled using an optical sensor where a size of a printed circuit board (PCB) is reduced.

2. Discussion of the Related Art

Generally, an LCD device displays desired images on a screen by controlling light transmittance from a back light unit using a liquid crystal panel. The liquid crystal panel includes a plurality of liquid crystal cells having a matrix arrangement and a plurality of control switches switching video signals supplied to the liquid crystal cells.

Recently, back light units have become smaller and lighter in weight. As a result, LEDs have been used instead of fluorescent lamps for back light units. The LEDs have a lower weight, consume less power, and have increased luminance.

FIG. 1 illustrates a related art back light unit having an LED.

Referring to FIG. 1, the related art back light unit 10 includes a plurality of LED arrays 30, a driver 40 for driving the LED arrays 30, and a diffusion plate 20 for diffusing light from the LED arrays 30.

The LED arrays 30, as shown in FIG. 2, include first to Nth LEDs 32 arranged on a PCB 31 in parallel with one another, first to Nth anode electrode lines 34, and first to Nth cathode electrode lines 36.

The PCB 31 is made of either nonmetal or metal. Here, the PCB 31 may be made of metal for improved heat radiation characteristics.

Each of the anode electrode lines 34 is electrically connected to both the driver 40 and anode electrodes of the LEDs 32 thereby supplying a constant current from the driver 40 to the anode electrodes of the LEDs 32. The anode electrode lines 34 are arranged at predetermined intervals in one area of the PCB 31 where the anode electrode lines are parallel with one another.

Each of the cathode electrode lines 36 is electrically connected between cathode electrodes of the LEDs 32 and the driver 40 to supply a ground voltage. The cathode electrode lines 36 are arranged at predetermined intervals in another area of the PCB 31 where the cathode electrode lines are parallel with one another.

Meanwhile, the anode electrode lines 34 and the cathode electrode lines 36 are formed at constant intervals to have a line width which corresponds a current of several hundred mA supplied to the LEDs 32.

Each of the LEDs 32 includes an anode electrode electrically connected to the anode electrode lines 34 and a cathode electrode electrically connected to the cathode electrode lines 36. As shown in the FIG. 2, the LEDs 32 are arranged on the PCB 31 such that they are parallel with one another and repeat the order of red, green and blue.

The LEDs 32 emit light using the constant current supplied from the driver 40 through the anode electrode lines 34 to emit white light through a mixture of red, green and blue lights. As such, white light is irradiated onto the diffusion plate 20. Each of the LEDs 32 arranged on the PCB 31 has a chip type configuration.

The driver 40, as shown in FIG. 3, includes a constant current generator 42 generating constant currents I1 to In, a feedback circuit 44 electrically connected to the cathode electrode lines 36 of the PCB 31 to generate feedback signals Fb1 to Fbn of the PCB 31, and a controller 46 for controlling the constant current generator 42 depending on the feedback signals Fb1 to Fbn from the feedback circuit 44.

The constant current generator 42 generates first to Nth constant currents I1 to In to irradiate each of the LEDs 32. The constant current generator 42 uses an external input voltage Vin controlled by the controller 46. The constant current generator 42 supplies the generated constant currents I1 to In to each of the anode electrode lines 34 of the PCB 31.

The controller 46 increases or decreases the size of each of the constant currents I1 to In supplied to each of the LEDs 32. The controller adjusts the constant current depending on each of the feedback signals Fb1 to Fbn from the feedback circuit 44 to control the constant current generator 42, thereby uniformly maintaining the current flow in the LEDs 32.

The feedback circuit 44, as shown in FIG. 4, includes a plurality of feedback resistors R electrically connected between each of the cathode electrode lines 36 formed on the PCBs 31 and a ground power source. The feedback circuit 44 detects a voltage applied at both ends of each feedback resistor R using the feedback signal Fb and supplies the detected voltage to the controller 46.

The driver 40 generates first to Nth constant currents I1 to In to drive each of the LEDs in parallel. Simultaneously, the driver 40 detects the feedback signal Fb corresponding to the current flow in each of the LEDs 32, which emits light, using the feedback resistors R. The driver 40 supplies the constant current to each of the LEDs 32 even if load characteristics of each LED 32 are varied due to characteristic variation and line resistance of each LED 32.

However, the related art back light unit 10 having the LED fails to control the current flow in each of the LEDs 32 if the voltage of the feedback signal Fb varies as the temperature of the resistor R of the feedback circuit 44 varies.

Furthermore, because the related art back light unit 10 having a LED requires a great amount of current, this complicates the line patterns on the PCB 31 when the size of the PCB 31 increases. Furthermore, the use of metal for the PCB 31 increases fabrication costs.

SUMMARY OF THE INVENTION

Accordingly, the present invention is directed to a back light unit and an LCD device using the same, which substantially obviate one or more problems due to limitations and disadvantages of the related art.

An advantage of the present invention is to provide a back light unit and an LCD device using the same in which currents flowing in a plurality of LEDs are uniformly controlled using an optical sensor and the size of the PCB is reduced.

Additional advantages and features of the invention will be set forth in part in the description which follows and in part will become apparent to those having ordinary skill in the art upon examination of the following or may be learned from practice of the invention. The advantages of the invention may be realized and attained by the structure particularly pointed out in the written description and claims hereof as well as the appended drawings.

To achieve these advantages and in accordance with the purpose of the invention, as embodied and broadly described herein, back light unit including a plurality of light emitting diode (LED) arrays, a detector and a driver is disclosed. The LED arrays have a plurality of light emitting diodes (LEDs). The detector detects a feedback signal where the feedback signal corresponds to a current which is input to the LEDs. The driver drives the LEDs according to the feedback signal from the detector where the detector is an optical sensor.

The driver includes a current generator generating the current and supplying the current to each of the LEDs through the detector, and a controller controlling the current generator depending on the feedback signal from the detector.

The detector is electrically connected between each output terminal of the current generator and each anode electrode of the LEDs to detect the feedback signal using the current generated from the current generator. The detector may also be included in the driver.

The detector includes a light emitting device supplying the current from the current generator to the anode electrode and emitting light depending on the current, and a light receiving device converting the light from the light emitting device into the feedback signal and supplying the feedback signal to the controller.

Each of the LED arrays includes a PCB on which the LEDs are arranged, anode electrode lines formed on the PCB, supplying the current from the current generator to the anode electrodes of the LEDs, and a ground line formed on the PCB and commonly connected to cathode electrodes of the LEDs.

In another aspect of the present invention, an LCD device including a liquid crystal injected between an upper substrate and a lower substrate and a back light unit which irradiates light onto the liquid crystal panel is disclosed. The back light unit includes a plurality of LED arrays having a plurality of light emitting diodes (LEDs), a detector and a driver. The detector detects a feedback signal where the feedback signal corresponds to a current which is input to the LEDs. The driver drives the LEDs according to the feedback signal from the detector.

The back light unit further includes a lamp housing receiving the LED arrays, a diffusion plate arranged on the lamp housing, and a plurality of optical sheets arranged on the diffusion plate.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the embodiments of the present invention, examples of which are illustrated in the accompanying drawings. Wherever possible, the same reference numbers will be used throughout the drawings to refer to the same or like parts.

Figure 1:
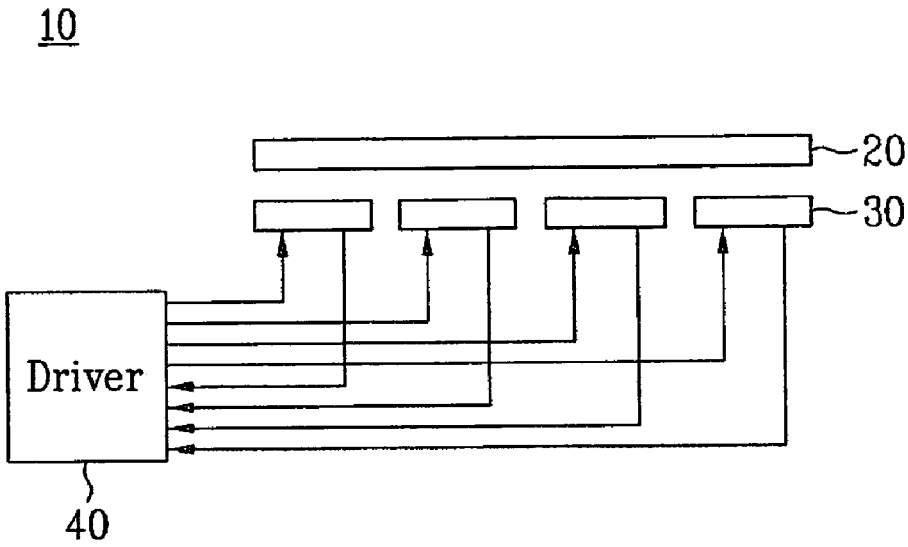
FIG. 1 Related Art
FIG. 1 illustrates a related art back light unit having an LED.
Figure 2:
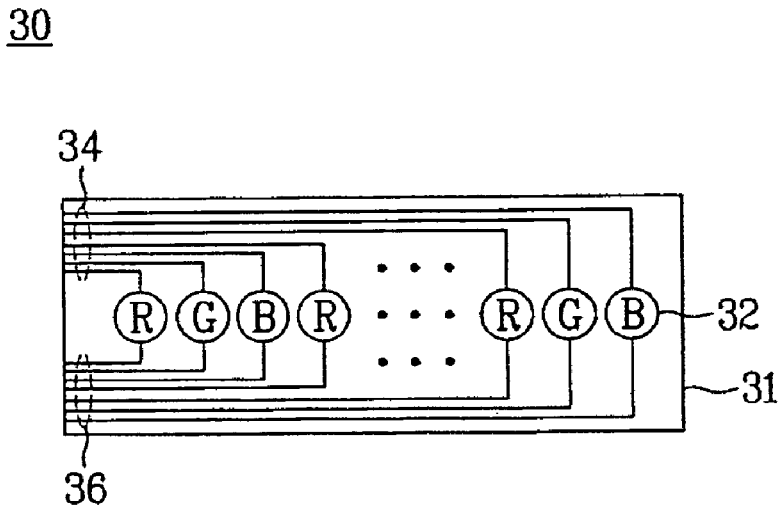
FIG. 2 Related Art
FIG. 2 is a plan view illustrating LED arrays shown in FIG. 1.
Figure 3:
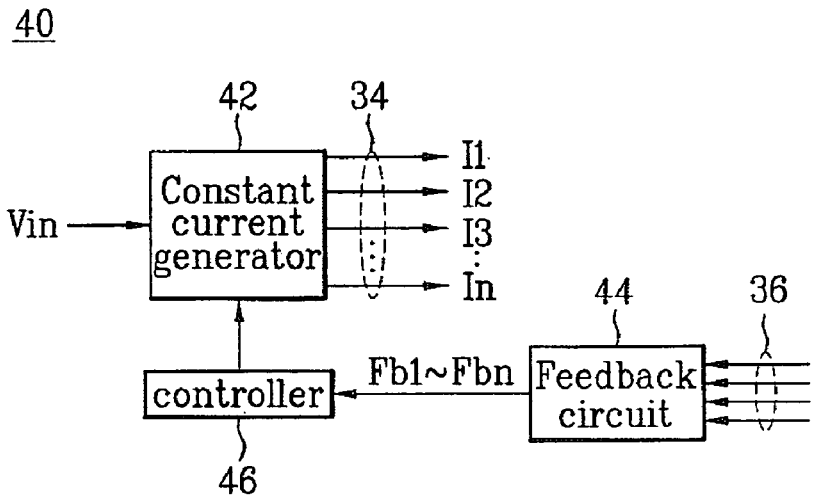
FIG. 3 Related Art
FIG. 3 illustrates a driver shown in FIG. 1.
Figure 4:
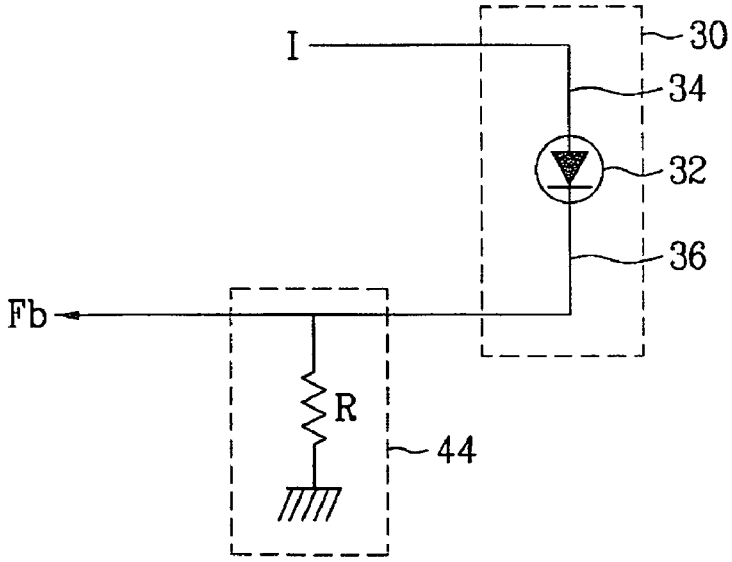
FIG. 4 Related Art
FIG. 4 illustrates a feedback circuit and an LED shown in FIG. 3.
Figure 5:
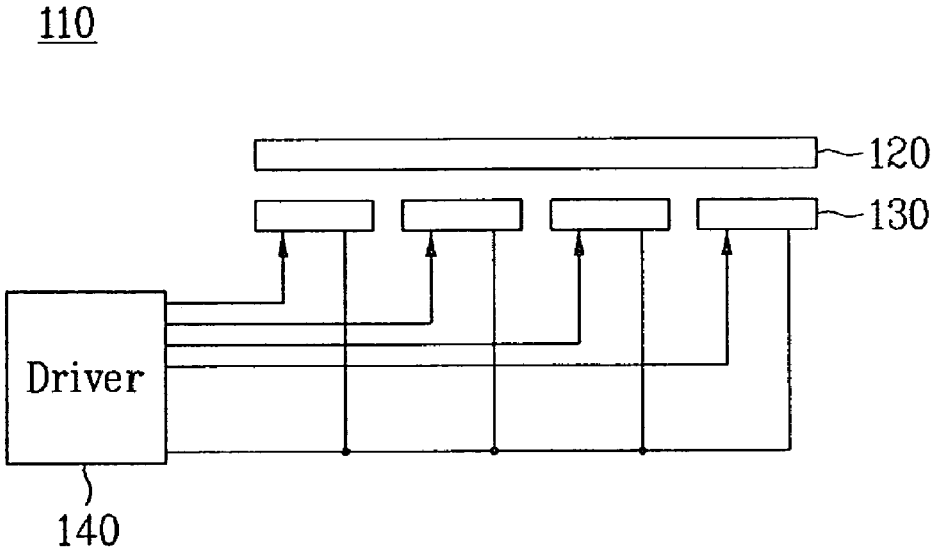
FIG. 5 illustrates a back light unit having an LED according to an embodiment of the present invention.

FIG. 5 illustrates a back light unit having an LED according to an embodiment of the present invention.

Referring to FIG. 5, the back light unit 110 having an LED according to an embodiment of the present invention includes a plurality of LED arrays 130, a driver 140 for detecting feedback signals corresponding to currents respectively input to the LEDs. The driver 140 uses an optical sensor and drives the LED arrays 130 depending on the detected feedback signals. The back light unit 110 also has a diffusion plate 120 for diffusing light from the LED arrays 130.

Figure 6:
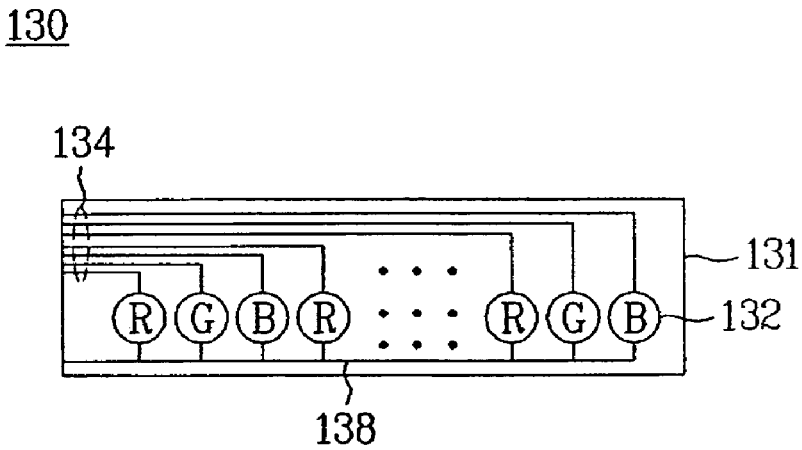
FIG. 6 is a plan view illustrating LED arrays shown in FIG. 5.

The LED arrays 130, as shown in FIG. 6, include first to Nth LEDs 132 arranged on a PCB 131 where the first to Nth LEDs 132 are parallel with one another. The LED arrays 130 also include first to Nth anode electrode lines 134 and a ground line 138.

The PCB 131 is made of either a nonmetal or a metal. In one embodiment, the PCB 131 may be made of a metal in order to improve heat radiation characteristics.

Each of the anode electrode lines 134 is electrically connected to both the driver 140 and anode electrodes of the LEDs 132. The anode electrode lines 134 supply a constant current from the driver 140 to each of the anode electrodes of the LEDs 132. The anode electrode lines 134, which are parallel with one another, are arranged at predetermined intervals at one area of the PCB 131.

The ground line 138 is electrically connected to a cathode electrode of each LED 132. The ground line 138 supplies a ground voltage from the driver 140 to the cathode electrodes of the LEDs 132.

The anode electrode lines 134 are formed at intervals having a line width such that a current of several hundred mA may be supplied to the LEDs 132. Thus, the anode electrode lines 134 and the ground line 138 reduce the size of the PCB 131 to one half the size of a related art PCB.

Each of the LEDs 132 includes an anode electrode electrically connected to one of the anode electrode lines 134 and a cathode electrode electrically connected to the ground line 138. The LEDs 132 are parallel with one another on the PCB 131 and repeat in the order of red, green and blue.

The LEDs 132 emit light using the current supplied from the driver 140 through the anode electrode lines 134. The LEDs 132 emit white light through a mixture of red, green and blue lights, thereby irradiating the white light onto the diffusion plate 120. Each of the LEDs 132 arranged on the PCB 131 has a chip type configuration.

Figure 7:
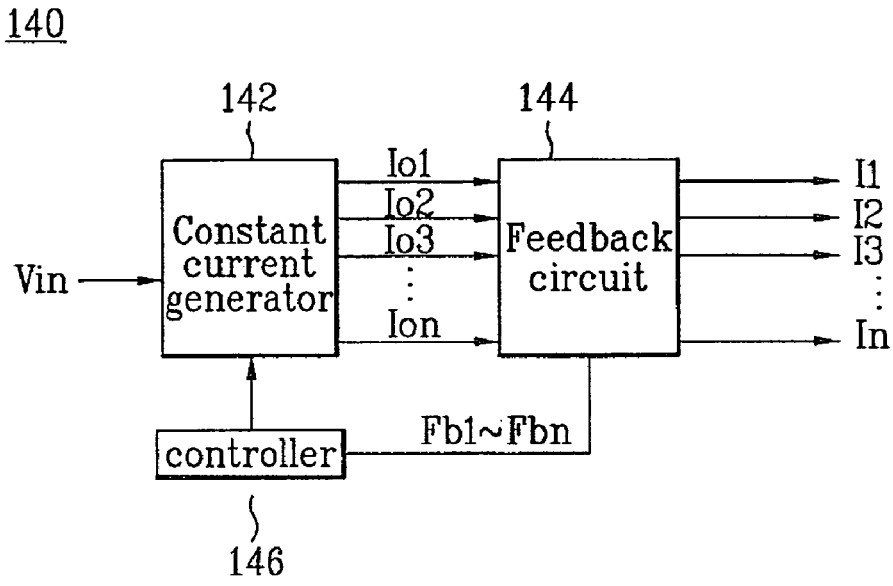
FIG. 7 illustrates a driver shown in FIG. 5.

The driver 140, as shown in FIG. 7, includes a constant current generator 142 which generates constant currents I1 to In. The driver 140 also has a feedback circuit (or detector) 144 which generates feedback signals Fb1 to Fbn which correspond to the currents respectively input to each LED 132 using the optical sensor electrically connected to output terminals Io1 to Ion of the constant current generator 142. In addition, the driver 140 includes a controller 146 controlling the constant current generator 142 based on the feedback signals Fb1 to Fbn from the feedback circuit 144.

The controller 146 causes the constant current generator 142 to generate first to Nth currents I1 to In to irradiate each of the LEDs 132 using an externally input voltage Vin. The constant current generator 142 supplies the currents I1 to In to each of the anode electrode lines 134 of the PCB 131 through the output terminals Io1 to Ion and the feedback circuit 144.

The controller 146 uniformly maintains the current flow in the LEDs 132 by increasing or decreasing the magnitude of each of the constant currents I1 to In supplied to each of the LEDs 132 in accordance with each of the feedback signals Fb1 to Fbn from the feedback circuit 144 thereby controlling the constant current generator 142.

Figure 8:
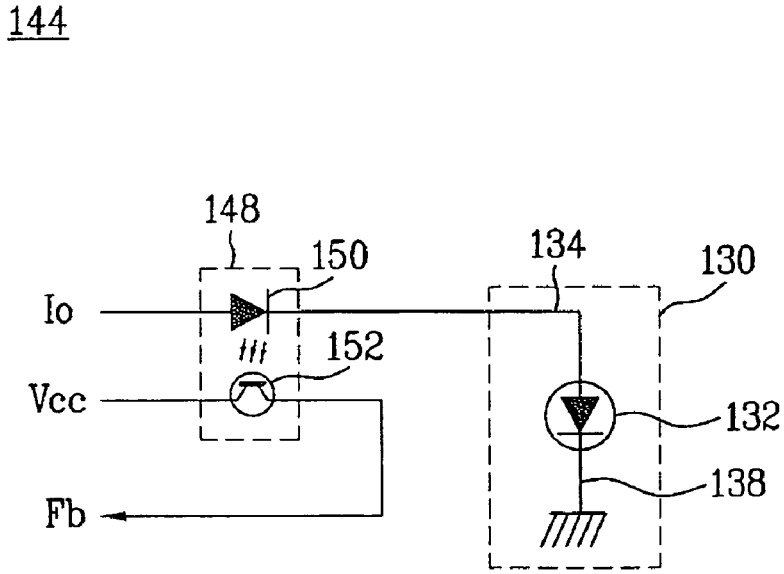
FIG. 8 illustrates a feedback circuit and an LED shown in FIG. 7.

The feedback circuit 144, as shown in FIG. 8, includes an optical sensor 148 electrically connected between each of the output terminals Io1 to Ion of the constant current generator 142 and each of the anode electrode lines 134 formed on the PCB 131.

The optical sensor 148 includes a light emitting device 150 which emits light using the currents from the constant current generator 142. The optical sensor 148 also has a light receiving device 152 which generates the feedback signals Fb1 to Fbn using light from the light emitting device 150. The optical sensor 148 may be a photo coupler.

The optical sensor 148 irradiates the light emitting device 150 using the currents from the constant current generator 142 thereby converting the current to a light intensity. In this embodiment, the light intensity is proportional to the current. The optical sensor 148 receives light from the light emitting device using the light receiving device 152 where the light receiving device 152 converts the intensity of radiation into electrical signals, i.e., feedback signals Fb 1 to Fbn. Then, the optical sensor 148 supplies the feedback signals Fb1 to Fbn to the controller 146. In addition, the currents from the constant current generator 142 are respectively supplied to the anode electrode lines 134 of the PCB 131 through the light emitting device 150 of the optical sensor 148. In one embodiment, a gallium arsenide infrared light emitting diode may be used as the light emitting device 150, and a silicon photodiode may be used as the light receiving device 152.

The optical sensor 148 may be optically formed by interposing a transparent resin therein. For example, the optical sensor 148 is molded with a resin in order to block external light and increase mechanical integrity. If the optical sensor 148 is a semiconductor, it has a small size, is photo sensitive, and has fast response characteristics. Also, the optical sensor is resistant to noise since it uses light. Moreover, the optical sensor 148 can insulate currents between the circuits and operate stably regardless of temperature variation.

The driver 140 generates first to Nth constant currents I1 to In in order to drive each of the LEDs 132 in parallel. Simultaneously, the driver 140 detects the feedback signal Fb corresponding to the current supplied to each of the LEDs 132 using the optical sensor 148. The driver 140 supplies the current to each of the LEDs 132 if load characteristics of each LED 132 vary depending on environmental variations such as the variation of characteristics and line resistance of each LED 132.

In the aforementioned back light unit 110 having the LED according to an embodiment of the present invention, the optical sensor 148 uniformly controls current flowing in each of the LEDs 132 by detecting the feedback signal Fb which corresponds to the current that is input to the anode electrode of each LED 132 from the constant current generator 142.

Furthermore, in the aforementioned back light unit 110 having the LED according to an embodiment of the present invention, the size of the PCB 131 may be decreased by commonly connecting the cathode electrodes of the first to Nth LEDs 132 to one ground line 138. Thus, it is possible to decrease manufacturing costs when the PCB 131 is made of metal in order to minimize heat radiation.

Meanwhile, in the aforementioned back light unit 110 using an LED according to an embodiment of the present invention, one current has been supplied to one LED 132. However, the current may also be supplied to at least two LEDs 132.

Furthermore, in the aforementioned back light unit 110 using an LED according to an embodiment of the present invention, the feedback signal Fb corresponding to the current supplied to one LED 132 has been detected. However, the feedback signal Fb corresponding to the constant current supplied to at least two LEDs 132 may also be detected.

Figure 9:
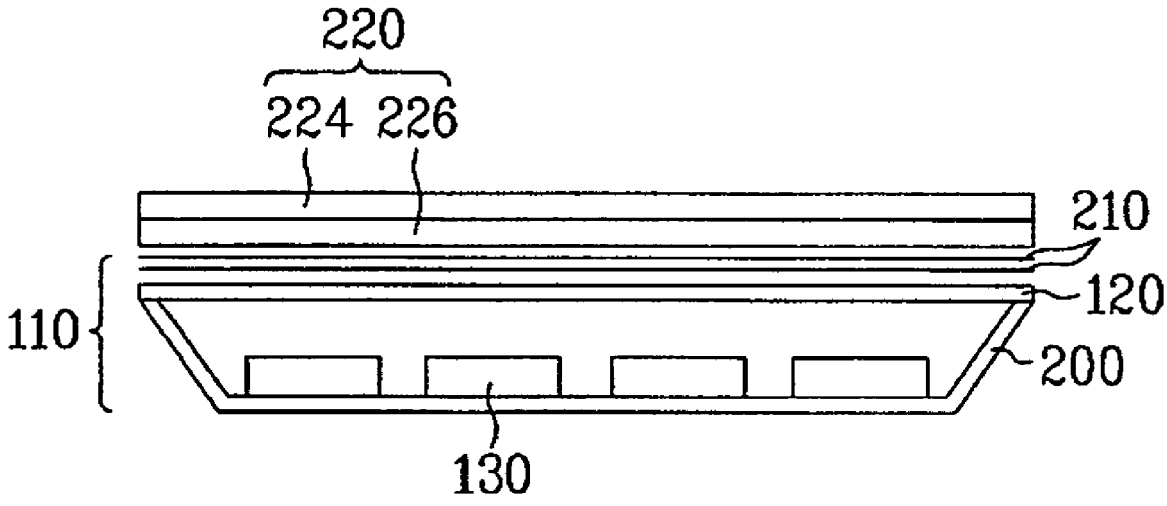
FIG. 9 illustrates an LCD device having a back light unit having an LED according to an embodiment of the present invention.

FIG. 9 illustrates an LCD device having the back light unit 110 using an LED according to an embodiment of the present invention.

Referring to FIG. 9, the LCD device according to an embodiment of the present invention includes a liquid crystal panel 220 and the back light unit 110 having an LED that irradiates light onto the liquid crystal panel 220.

The liquid crystal panel 220 includes a liquid crystal injected between an upper substrate 224 and a lower substrate 226 and a spacer (not shown) for maintaining a constant interval between the upper substrate 224 and the lower substrate 226.

The upper substrate 224 of the liquid crystal panel 220 is provided with color filters, a common electrode, and a black matrix.

The lower substrate 226 of the liquid crystal panel 220 is provided with signal lines including data lines and gate lines and thin film transistors formed at crossing points between the data lines and the gate lines.

Each of the thin film transistors switches an image signal, which is to be transmitted from the data lines to a liquid crystal cell, in response to a scan signal (gate pulse) from the gate lines. A pixel electrode is formed in each pixel region between the data lines and the gate lines.

The liquid crystal panel 220 is provided with data and gate pad regions respectively connected to the data lines and the gate lines. An upper polarizing plate is fixed to a front surface of the upper substrate 224, and a lower polarizing plate is fixed to a rear surface of the lower substrate 226.

The back light unit 110 using an LED irradiates light onto the liquid crystal panel 220 using the aforementioned LED arrays 130.

Meanwhile, the back light unit 110 having the LED includes a lamp housing 200 receiving the LED arrays 130, a diffusion plate 120 arranged on the lamp housing 200, and a plurality of optical sheets 210 arranged on the diffusion plate 120.

The diffusion plate 120 diffuses incident light from the LED arrays 130 to irradiate the incident light onto the optical sheets 210.

Each of the optical sheets 210 converts a light path such that the diffused light from the diffusion plate 120 travels toward the liquid crystal panel 220, thereby improving light efficiency.

In the aforementioned LCD device according to an embodiment of the present invention, a desired image is displayed in the liquid crystal panel 220 by controlling transmittance of light irradiated onto the liquid crystal panel 220 from the back light unit 110 using the LED.

As described above, the back light unit and the LCD device using the same according to the present invention have the following advantages.

It is possible to uniformly control the current flowing in each of the LEDs by stably detecting the feedback signal corresponding to the current input to the light emitting diode using the optical sensor regardless of temperature variation.

Also, it is possible to efficiently form a line using minimal space on a PCB by commonly connecting the cathode electrodes of the LEDs formed on the PCB to one ground line. Moreover, it is possible to reduce the manufacturing cost of the back light unit by reducing the size of the PCB.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A back light unit comprising:

a plurality of light emitting diode (LED) arrays, the LED arrays having a plurality of light emitting diodes (LEDs);

a detector which detects a feedback signal where the feedback signal corresponds to a current which is input to the LEDs; and a driver which drives the LEDs according to the feedback signal from the detector;

wherein the driver includes:

a current generator which generates a current and supplies the current to each LED of the plurality of LEDs through the detector; and a controller which controls the current generator according to the feedback signal from the detector;

wherein the detector includes:

a light emitting device which supplies the current from the current generator to each anode electrode of the LEDs and emits light in accordance with the current; and a light receiving device which converts the light from the light emitting device into the feedback signal and supplies the feedback signal to the controller.

2. The back light unit as claimed in claim 1, wherein the detector is an optical sensor.

3. The back light unit as claimed in claim 1, wherein the detector is electrically connected between each output terminal of the current generator and the each anode electrode of the LEDs to detect the feedback signal using the current generated from the current generator.

4. The back light unit as claimed in claim 3, wherein the driver includes the detector.

5. The back light unit as claimed in claim 1, wherein each of the LED arrays includes:

a PCB on which the LEDs are arranged;

anode electrode lines formed on the PCB, the anode electrode lines supplying the current from the current generator to the anode electrodes of the LEDs; and a ground line formed on the PCB and commonly connected to cathode electrodes of the LEDs.

6. An LCD device comprising:

a liquid crystal injected between an upper substrate and a lower substrate; and a back light unit which irradiates light onto the liquid crystal panel, wherein the back light unit includes:

a plurality of LED arrays having a plurality of light emitting diodes (LEDs);

a detector which detects a feedback signal where the feedback signal corresponds to a current which is input to the LEDs; and a driver which drives the LEDs according to the feedback signal from the detector;

wherein the driver includes:

a current generator which generates a current and supplies the current to each LED of the plurality of LEDs through the detector; and a controller which controls the current generator according to the feedback signal from the detector;

wherein the detector includes:

a light emitting device which supplies the current from the current generator to each anode electrode of the LEDs and emits light in accordance with the current; and a light receiving device which converts the light from the light emitting device into the feedback signal and supplies the feedback signal to the controller.

7. The LCD device as claimed in claim 6, wherein the detector is an optical sensor.

8. The LCD device as claimed in claim 6, wherein the detector is electrically connected between each output terminal of the current generator and the each anode electrode of the LEDs to detect the feedback signal using the current generated from the current generator.

9. The LCD device as claimed in claim 6, wherein the driver includes the detector.

10. The LCD device as claimed in claim 6, wherein each of the LED arrays includes:

a PCB on which the LEDs are arranged;

anode electrode lines formed on the PCB, the anode electrode lines supplying the current from the current generator to the anode electrodes of the LEDs; and a ground line formed on the PCB and commonly connected to cathode electrodes of the LEDs.

11. The LCD device as claimed in claim 6, wherein the back light unit further includes:

a lamp housing which holds the LED arrays;

a diffusion plate disposed on the lamp housing; and a plurality of optical sheets disposed on the diffusion plate.

* * * * *